US006626646B2

(12) United States Patent
Rajewski

(10) Patent No.: US 6,626,646 B2
(45) Date of Patent: Sep. 30, 2003

(54) VEHICLE MOUNTED GAS WELL PUMPING UNIT

(76) Inventor: Robert C. Rajewski, R.R. #1, Donalda, Alberta (CA), T0B 1H0

( * ) Notice: Subject to any disclaimer, the term of this patent is extended or adjusted under 35 U.S.C. 154(b) by 0 days.

(21) Appl. No.: 10/032,304

(22) Filed: Dec. 21, 2001

(65) Prior Publication Data

US 2003/0077181 A1 Apr. 24, 2003

(30) Foreign Application Priority Data

Oct. 19, 2001 (CA) ..... 2359441

(51) Int. Cl.[7] ..... F04B 17/06; F04B 53/00; F04B 17/00

(52) U.S. Cl. ..... 417/231; 417/234; 417/364; 417/572

(58) Field of Search ..... 417/231, 234, 417/316, 313, 364, 572; 166/369, 370; 175/217

(56) References Cited

U.S. PATENT DOCUMENTS

| | | | | |
|---|---|---|---|---|
| 797,790 A | | 8/1905 | Caffall | |
| 1,755,395 A | | 4/1930 | Hicks | |
| 1,862,400 A | | 6/1932 | Herman | |
| 1,900,415 A | | 3/1933 | Fullerton | |
| 2,106,085 A | | 1/1938 | Davey | 180/53 |
| 3,787,146 A | * | 1/1974 | Eriksson | 417/299 |
| 3,789,820 A | * | 2/1974 | Douglas et al. | 123/27 GE |
| 4,139,019 A | * | 2/1979 | Bresie et al. | 137/351 |
| 4,342,199 A | * | 8/1982 | Shaw et al. | 62/133 |
| 5,056,601 A | * | 10/1991 | Grimmer | 165/47 |
| 5,145,014 A | | 9/1992 | Eberhardt | 169/14 |
| 5,242,278 A | | 9/1993 | Vanderslice et al. | 417/364 |
| 6,176,690 B1 | * | 1/2001 | Knepp | 417/359 |

OTHER PUBLICATIONS

Product information, Vanair Manufacturing Inc., 4 pages, Sep. 13, 2001.

* cited by examiner

*Primary Examiner*—Charles G. Freay
*Assistant Examiner*—Timothy P. Solak
(74) *Attorney, Agent, or Firm*—Christensen O'Connor Johnson Kindness PLLC

(57) ABSTRACT

An in-line gas compression system, comprising a vehicle, preferably a truck, having a drive train, with a gas compressor mounted on the vehicle and driven by the drive train of the vehicle. The gas compressor is connected through a filter to a gas inlet and has a compressed gas outlet line. When a rotary screw gas compressor is used, an oil and gas separator is provided on the compressed gas outlet line, with the oil and gas separator being connected to return oil to the rotary screw gas compressor. The in-line gas compression system is typically connected into a gas pipeline system through the compressed gas outlet line, and is connected to a source of gas, for example a well at a well site.

8 Claims, 1 Drawing Sheet

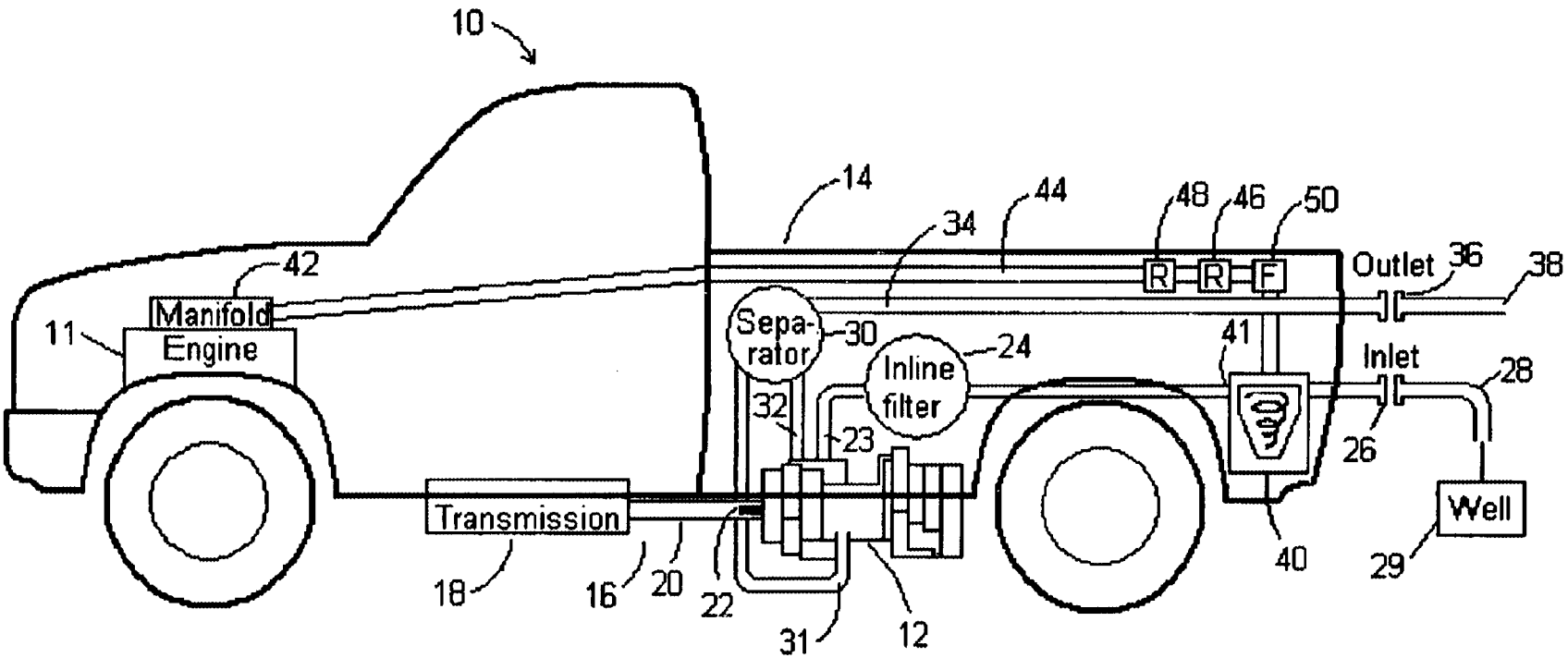
10
11
Engine
Manifold
42
14
44
34
48
R
46
R
50
F
Separator
30
32
Inline filter
24
23
Outlet
36
38
Inlet
28
26
41
40
Well
29
12
31
22
20
16
Transmission
18

VEHICLE MOUNTED GAS WELL PUMPING UNIT

BACKGROUND OF THE INVENTION

This invention relates to the production and delivery of natural gas, particularly from low producing gas wells.

Gas wells may be high, mid or low producers. For low producing wells, economic delivery of gas to consumers poses a substantial challenge. Low producing wells typically do not have high pressure, thus to enable gas to reach a gas pipeline for processing and subsequent delivery to customers, the gas must be compressed by a gas compressor. Conventionally, skid mounted or trailer mounted gas compressors have been used for this purpose. However, such gas compressors have their own drive engine, which adds to the complexity and expense of the gas compression system as a whole. This invention is directed towards providing a simple, cost effective solution to the problem of economic delivery of gas from low producers.

SUMMARY OF THE INVENTION

This invention, in its various aspects, provides an in-line gas compression system, comprising a vehicle, preferably a truck, having a drive train and an engine, with a gas compressor mounted on the vehicle and driven by the drive train of the vehicle. The gas compressor is connected to receive a supply of clean natural gas and has a compressed gas outlet line. A rotary screw gas compressor is preferably used for the gas compressor, and an oil and gas separator is provided on the compressed gas outlet line, with the oil and gas separator being connected to return oil to the rotary screw gas compressor. The gas compressor may be supplied with gas through a gas-liquid separator. Regulated natural gas may be taken from the gas-liquid separator to power the engine of the vehicle through a natural gas intake manifold.

The in-line gas compression system is typically connected into a gas pipeline system through the compressed gas outlet line, and is connected to a source of gas, for example a gas well at a well site.

These and other aspects of the invention are described in the detailed description of the invention and claimed in the claims that follow.

BRIEF DESCRIPTION OF THE DRAWINGS

There will now be described preferred embodiments of the invention, with reference to the sole FIGURE, by way of illustration only and not with the intention of limiting the scope of the invention, the FIGURE showing a side view schematic of an embodiment of the invention.

DETAILED DESCRIPTION OF PREFERRED EMBODIMENTS

In this patent document, the word "comprising" is used in its non-limiting sense to mean that items following the word in the sentence are included and that items not specifically mentioned are not necessarily excluded. The use of the indefinite article "a" in the claims before an element means that one of the elements is included, but does not specifically exclude others of the elements being present, unless the context clearly requires that there be one and only one of the elements.

Referring to the FIGURE, there is shown an in-line gas compression system. The system is vehicle mounted. A preferred vehicle is a commercially available ¾ ton truck 10 with an internal combustion engine 11 generating preferably 180 to 300 hp. The truck 10 preferably has a conventional tachometer (not shown) and cruise control (not shown). General Motors trucks such as the 2500 series, two wheel drive, or Dodge trucks may be used with good success, but any other make with sufficient power and reliability would be suitable. A gas compressor 12 is mounted on truck 10 in any of various ways such as on, in, beside or under the rear box 14 of the truck 10. The gas compressor 12 may be mounted on the chassis, or within the truck box 14, or any other suitable place. For some applications, mounting of the gas compressor 12 may be preferably in the rear box 14. The gas compressor 12 may be a rotary screw gas compressor available from any of a number of manufacturers such as CompAir LeROI of Sidney, Ohio, USA, or Gardner Denver, Inc. of Quincy, Ill., USA.

The gas compressor 12 is driven directly by the drive train 16 of the truck 10. The drive train 16 in this instance includes transmission 18 and drive shaft 20, but may include a power take off, or any other components that receive power from the vehicle engine 11. The gas compressor 12 may be linked to the drive train 16 by connection of the drive shaft 20 of the truck 10 to the shaft 22 of the rotary screw gas compressor 12. This is particularly suitable for when the gas compressor 12 is mounted on the chassis of the truck 10. Alternatively, when the gas compressor 12 is mounted on the rear bed, a pulley and belts (not shown) may be used to connect the drive shaft 20 to the shaft 22 of the screw compressor 12.

The gas compressor 12 has a clean gas inlet line 23 to receive a clean supply of natural gas. The natural gas is supplied through conventional gas filter 24 and gas inlet 26. The gas filter 24 may for example be obtained from any of various suppliers such as the North American Filter Corporation of Newark, N.Y., USA. A clean gas inlet line is an input line arranged to supply gas to the gas compressor 12 that is sufficiently clean for economic operation of the gas compressor 12. A conventional gas filter 24 may be used for this purpose if the gas from the well is insufficiently clean for the purposes of the gas compressor 12. The gas inlet 26 is connected to a line 28, which may be fed directly from a gas pipeline or a gas well 29 at a well site. The gas compressor 12 is also connected to deliver gas through a line 31 to an oil and gas, separator 30, also readily commercially available such as from Gardner Denver or CompAir LeROI for use in association with the respective company's rotary screw compressor. Oil is returned from the oil and gas separator 30 to the gas compressor 12 through line 32, which should include an oil filter such as a dual oil filter available from Donaldson Company, Inc. of Minneapolis, Minn., USA. Compressed gas from the oil and gas separator 30 is delivered along line 34 to a gas outlet 36, which may be connected directly into a gas pipeline 38.

Preferably, there is also provided, after the gas inlet 26 and before the inline filter 24, a gas-liquid separator 40. A discharge port 41 of the gas-liquid separator 40 is connected to supply gas through the inline filter 24 to the gas compressor 12. The gas-liquid separator 40 may be a conventional gas-liquid separator, as are commonly used in the oil industry. It is desirable to use a separator, such as a cyclone separator, that is most effective in separating heavy from light material. The separator 40 should be provided with a cut-off system, for example, using a float and cut-off valve in the separator 40, so that if the separator 40 becomes filled with liquid, the separator 40 shuts off. The shutting off of the separator 40 presents a low pressure to the screw compressor 12 and conventional internal controls within the screw compressor 12 shut down the screw compressor 12. The separator 40 helps reduce water and particulate contamination of the screw compressor 12.

The truck 10 may be run using gasoline or diesel or any other suitable fuel. However, preferably the truck 10 runs off natural gas from the well 29. If the truck 10 is not factory made to handle natural gas, the truck 10 may be modified by incorporation of a natural gas intake manifold 42 to inject gas from the well 29 into the truck engine 11. The manifold may be a carbureter available from Impco of Cerritos, Calif., USA and Sterling Heights, Mich., USA. The separator 40 is preferably used to supply the natural gas from the well 29 to the intake manifold 42 and for that purpose is connected directly to the intake manifold 42 via line 44, which may be secured to the frame of the truck 10. Gas from the separator 40 will normally have a higher pressure than is desirable for the intake manifold 42. The line 44 is thus provided with a first regulator 46 to bring the pressure down to 10 lbs, and then a second regulator 48 to bring the pressure from 10 lbs. to 2–3 ounces, depending on the requirements of the intake manifold 42. The regulators 46 and 48 are commercially available and may be for example a Fisher™ regulator obtained from Emerson Process Management of Cedar Rapids, Iowa, USA . A filter 50 as typically used on natural gas lines, for example a filter available from Balston Filters of Tewkesury, Mass., USA, is also provided on the line 44 to remove particulates from the regulated gas supply for the intake manifold 42.

The gas compression system described requires monitoring. An operator should check the operation of the system twice per day. The volume of the gas-liquid separator 40 will govern how often water in the gas-liquid separator 40 needs to be removed, and the operator will require a suitable disposal container to remove the water and dispose of it in conventional fashion.

The described system has few controls. The screw compressor 12 has a temperature control, which is operated conventionally. The system is put into operation by starting the truck 10, and the drive train 18 engaged. The engine speed is increased to a pre-set RPM, which may be monitored using a conventional tachometer. At the pre-set speed, the cruise control of the truck 10 is engaged. The desired RPM is determined from the production rate of the well and a curve provided by the manufacturer of the screw compressor that relates input gas pressure to output gas pressure. The desired production rate of the well is obtained from the well operator. The screw compressor curve is then consulted to determine what RPM for the screw compressor 12 will provide a desired output flow rate to the gas pipeline 38. The engine 11 is held at this RPM. With suitable monitoring, the inline gas compression system thus described may be run continuously except for service breaks.

A person skilled in the art could make immaterial modifications to the invention described in this patent document without departing from the essence of the invention.

I claim:

1. An in-line gas compression system, comprising:

a vehicle having a drive train;

a rotary screw gas compressor mounted on the vehicle, and being connected through a filter to a gas inlet, the gas inlet being connected to a natural gas well;

the rotary screw gas compressor having a compressed gas outlet line;

an oil and gas separator on the compressed gas outlet line, the oil and gas separator being connected to return oil to the rotary screw gas compressor;

the compressed gas outlet line being connected to supply compressed gas through a filter to a gas pipeline; and the rotary screw gas compressor being driven by the drive train of the vehicle.

2. An in-line gas compression system, comprising:

a truck having a drive train;

a rotary screw gas compressor mounted on the truck, and being connected through a filter to a gas inlet, the gas inlet being connected to a natural gas well;

the rotary screw gas compressor having a compressed gas outlet line;

an oil and gas separator on the compressed gas outlet line, the oil and gas separator being connected to return oil to the rotary screw gas compressor;

the compressed gas outlet line being connected to supply compressed gas through a filter to a gas pipeline; and the rotary screw gas compressor being driven by the drive train of the truck.

3. An in-line gas compression system, comprising:

a vehicle having a drive train and an engine that is powered by natural gas;

a gas compressor mounted on the vehicle;

the gas compressor having a clean gas inlet line and a compressed gas outlet line, the clean gas inlet line being connected to a gas well;

the engine of the vehicle being supplied with regulated natural gas from the gas well for powering the engine; and the gas compressor being driven by the drive train of the vehicle.

4. An in-line gas compression system, comprising:

a vehicle having a drive train and an engine that is powered by natural gas;

a gas compressor mounted on the vehicle;

the gas compressor having clean gas inlet line connected to receive gas from a gas well and having a compressed gas outlet line connected to a gas pipeline;

the engine of the vehicle being supplied with regulated natural gas from the gas well for powering the engine; and the gas compressor being driven by the drive train of the vehicle.

5. An in-line gas compression system, comprising:

a truck having a drive train and an engine that is powered by natural gas;

a gas compressor mounted on the truck;

the gas compressor having clean gas inlet line and a compressed gas outlet line, the clean gas inlet line being connected to receive gas from a gas well;

the engine of the truck being connected to be supplied with a regulated stream of natural gas from the gas well for powering the engine; and the gas compressor being driven by the drive train of the truck.

6. An in-line gas compression system, comprising:

a vehicle having a drive train, and an engine that is powered by natural gas through a natural gas intake manifold;

a gas compressor mounted on the vehicle;

the gas compressor having a clean gas inlet line and a compressed gas outlet line, the clean gas inlet line being connected to a gas well;

a gas-liquid separator on the clean gas inlet line, the gas-liquid separator having a gas discharge port connected to supply clean gas to the gas compressor;

the natural gas intake manifold of the truck being connected to receive regulated natural gas from the gas well; and the gas compressor being driven by the drive train of the vehicle.

7. An in-line gas compression system, comprising:

a vehicle having a drive train, and an engine powered by natural gas;

a rotary screw gas compressor mounted on the vehicle and having a gas inlet line connected through a filter to a gas inlet;

the rotary screw gas compressor having a compressed gas outlet line;

a gas-liquid separator on the gas inlet line, the gas-liquid separator having a gas discharge port connected to supply gas to the rotary screw gas compressor;

the engine being connected to be supplied with a regulated stream of natural gas that has passed through the gas-liquid separator;

an oil and gas separator on the compressed gas outlet line, the oil and gas separator being connected to return oil to the rotary screw gas compressor; and the rotary screw gas compressor being driven by the drive train of the vehicle.

8. An in-line gas compression system, comprising:

a truck having a drive train, and an engine powered by natural gas;

a rotary screw gas compressor mounted on the truck and having a gas inlet line connected through a filter to a gas inlet;

the gas inlet being connected to receive gas from a gas well;

the rotary screw gas compressor having a compressed gas outlet line connected through a filter to a pipeline;

a gas-liquid separator on the gas inlet line, the gas-liquid separator having a gas discharge port connected to supply gas to the rotary screw gas compressor;

the engine being connected for supply with a regulated stream of natural gas that has passed through the gas-liquid separator;

an oil and gas separator on the compressed gas outlet line, the oil and gas separator being connected to return oil to the rotary screw gas compressor; and the rotary screw gas compressor being driven by the drive train of the truck.

* * * * *